US008251442B2

(12) United States Patent
Grace

(10) Patent No.: US 8,251,442 B2
(45) Date of Patent: Aug. 28, 2012

(54) TWO-WAY FOLDABLE CHAIR

(75) Inventor: Daniel R. Grace, Old Saybrook, CT (US)

(73) Assignee: GCI Outdoor, Inc., Higganum, CT (US)

( * ) Notice: Subject to any disclaimer, the term of this patent is extended or adjusted under 35 U.S.C. 154(b) by 64 days.

(21) Appl. No.: 12/726,141

(22) Filed: Mar. 17, 2010

(65) Prior Publication Data

US 2010/0237664 A1 Sep. 23, 2010

Related U.S. Application Data

(60) Provisional application No. 61/160,886, filed on Mar. 17, 2009.

(51) Int. Cl.

| | |
|---|---|
| ***A47C 4/00*** | (2006.01) |
| ***A47C 4/28*** | (2006.01) |
| ***A47C 4/30*** | (2006.01) |
| ***A47C 4/42*** | (2006.01) |
| ***A47C 4/44*** | (2006.01) |

(52) U.S. Cl. ..... 297/45; 297/16.2; 297/378.1

(58) Field of Classification Search ..... 297/45, 297/16.2, 378.1

See application file for complete search history.

(56) References Cited

U.S. PATENT DOCUMENTS

| | | | | |
|---|---|---|---|---|
| 4,715,650 | A * | 12/1987 | Berman et al. | 297/45 X |
| 6,082,813 | A * | 7/2000 | Chen | 297/45 X |
| 6,302,479 | B1 * | 10/2001 | Zheng | 297/45 X |
| 6,364,409 | B1 * | 4/2002 | Saul et al. | 297/45 X |
| 6,406,091 | B1 * | 6/2002 | Saul et al. | 297/45 X |
| 6,736,450 | B2 * | 5/2004 | Miyagi | 297/45 X |
| 6,764,132 | B1 * | 7/2004 | Gaertner | 297/16.2 X |
| 6,926,356 | B2 * | 8/2005 | Chen | 297/45 |
| 7,017,984 | B2 * | 3/2006 | Chen | 297/45 |
| 7,073,852 | B1 * | 7/2006 | Zheng | 297/16.2 |
| 7,178,863 | B1 * | 2/2007 | Norval | 297/45 X |
| 7,717,503 | B1 * | 5/2010 | Watson | 297/45 |
| 2003/0025360 | A1 * | 2/2003 | Liu | 297/16.2 |
| 2003/0034675 | A1 * | 2/2003 | Marx | 297/45 |
| 2003/0071493 | A1 * | 4/2003 | Miyagi | 297/45 X |
| 2004/0207237 | A1 * | 10/2004 | Chen | 297/45 |
| 2004/0212224 | A1 * | 10/2004 | Chen | 297/45 X |
| 2008/0122268 | A1 * | 5/2008 | Kim | 297/16.2 |
| 2010/0072790 | A1 * | 3/2010 | Pleiman et al. | 297/45 |
| 2010/0171342 | A1 * | 7/2010 | Chen | 297/45 |
| 2011/0018312 | A1 * | 1/2011 | Grace | 297/16.2 |
| 2011/0169304 | A1 * | 7/2011 | Chen | 297/35 |

* cited by examiner

*Primary Examiner* — Rodney B White
(74) *Attorney, Agent, or Firm* — McCormick, Paulding & Huber LLP

(57) ABSTRACT

Two-way foldable outdoor chair selectively foldable from set-up position to a first flatly folded position or to a second bundled position may be prevented from being folded to the second position while at all times remaining foldable to the first position and may include an adjustable reclining position.

25 Claims, 12 Drawing Sheets

TWO-WAY FOLDABLE CHAIR

CROSS REFERENCE TO RELATED APPLICATION

This application claims the benefit of U.S. Provisional Application No. 61/160,886, filed Mar. 17, 2009, the disclosure of which is incorporated by reference in its entirety.

FIELD OF THE INVENTION

The present invention generally relates to chairs, and more particularly relates to improvements in chairs that are foldable and unfoldable between a set-up condition for use and a substantially collapsed condition for transportation and/or storage.

BACKGROUND OF THE INVENTION

Beach and lawn chairs adapted to be folded for transportation and/or storage typically have a frame fabricated from elongated structural members, preferably metal. The frames of such chairs have transversely spaced apart left hand and right hand frame side assemblies that are substantially parallel to each other. In a set-up position, each side frame assembly has a front leg member extending in a generally vertically upward direction and a rear leg member pivotally connected at its upper end directly or indirectly to an upper end of the front leg member and which is rearwardly and downwardly inclined from the upper end of the front leg member. Such frames also include an upwardly extending chair back support member which is or may be pivotally connected at its lower end to the rear leg member intermediate the ends of the rear leg member by an over-the-center linkage that positions the back support member so that it is supported at its lower end on the rear leg member and inclined upwardly and rearwardly therefrom when the chair is unfolded from its closed or flatly folded storage position to its open or set-up position for use.

Such conventional beach and lawn chairs of the prior art having the left hand and right hand frame side assemblies such as hereinbefore generally described also commonly have transversely extending rigid connecting members providing fixed connection between the front leg members, the rear leg members, and often the back support members as well. Additional rigidly fixed transverse connecting members may also extend between the structural members that support the seat of such a chair. The aforesaid rigid or noncollapsible transversely extending connecting members are generally horizontally disposed when such a conventional prior art chair is in its set-up position. Thus, it should be immediately apparent that conventional folding chairs of a prior art type as hereinbefore described are foldable to only one storage and/or transport position, namely a flatly folded position.

Such prior art chairs provide the convenience of easy fold-up, and are lightweight so as to permit easy transportability. Common uses for such chairs are at the beach or at a picnic where easy set-up and break-down, as well as the ability to carry the chair along with other things, is desirable. However, even though such chairs are foldable for easy transport, they typically still cover a wide area and thus occupy a considerable space when folded, which makes packing or storing the chairs difficult, especially when they must be crammed into small a space, such as the trunk of a car, with a number of other objects such as a cooler, blankets and bags. That is, most prior art beach and lawn chairs are foldable only in one direction—typically front to back. For example, the back support and the seat support of the chair are folded towards each other so the frame, when folded, lies flat and has an essentially rectangular shape. When packing the folded chair into a car, the folded chair must be laid flat, thereby occupying a wide footprint.

Other chair designs have been developed that can be folded to a collapsed state occupying less storage space. For example, some chair designs can be folded in multiple directions, reducing the front/back and side-to-side dimensions between an unfolded set-up position and a folded storage position. However, these chair designs are typically not suitable for certain outdoor uses, such as at the beach or at a picnic, where a reclinable back rest may be desired.

In view of the foregoing, there is a need for a chair when in a set-up condition that can be collapsed in multiple directions in order to reduce the space occupied by the chair in a folded and completely collapsed condition. Accordingly, it is a general object of the present invention to provide a chair design that overcomes problems and drawbacks associated with folding chairs, and therefore significantly improves the versatility of such a chair while permitting easy transportation and/or storage in a completely collapsed condition.

Moreover, there is a need for a reclinable and collapsible chair that can be easily folded by a user with minimal effort. Hereafter, reclinable chairs have not been able to be folded to a completely collapsed, bundled condition without much difficulty. Even where a reclinable chair can be so bundled, the final bundle does not fold to a sufficiently compressed size.

SUMMARY OF THE INVENTION

The present invention is directed to a chair especially suitable for use as a beach chair, a lawn chair, and the like, where the chair, in a set-up condition, has a reclining back support adjustable to a number of positions, and where the chair can be folded from the set-up condition to a completely collapsed condition. More particularly, in the completely collapsed condition, the chair is folded and collapsed in multiple directions, so that the front/back and left/right dimensions of the chair are reduced between the set-up condition and the completely collapsed condition.

Unlike the prior art hereinbefore described, chairs of the present invention do not include or rely on rigid or non-collapsible connecting members which are fixedly connected to and extend between opposite side frame members to prevent movement of the side members either toward or away from each other.

In accordance with an aspect of the present invention, a foldable chair includes left and right frame side members, forward and rear leg members, and a seat support and a back support, directly or indirectly interconnected by a combination of pivotal, slidable and telescopically movable connections that enable maintenance of the chair frame in an open or set-up condition wherein the left and right frame side members, the forward and rear leg members, and the seat support and back support are maintained in an open position corresponding to the set-up condition of the chair. The combination of pivotal, slidable and telescopically movable structural members enable the chair frame to be folded or collapsed in multiple directions, including at least the transverse, side-to-side direction and the front-to-back direction, by moving the chair frame members toward each other and a centrally disposed vertical axis from the open condition.

These and other features of the present invention are described with reference to the drawings of preferred embodiments of a chair. The illustrated embodiments of features of the present invention are intended to illustrate, but not limit the invention.

DETAILED DESCRIPTION OF THE INVENTION

Figure 1:
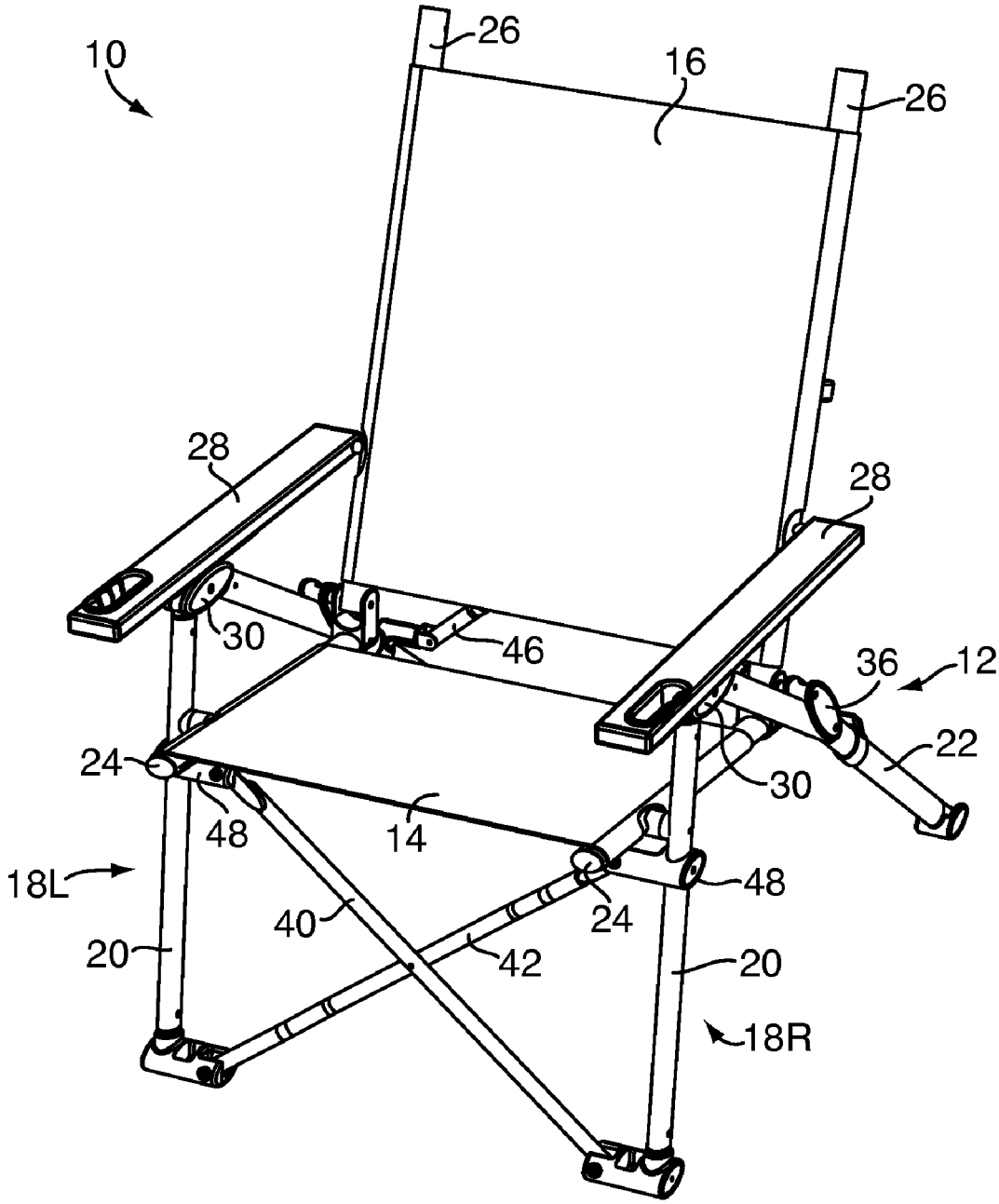
FIG. 1 is a front perspective view of a two-way foldable chair embodying the invention and shown in set-up condition ready for use.

In the drawings and in the description which follows the present invention is illustrated and described with reference to a two-way foldable reclining chair embodying the invention and indicated generally at 10. The illustrated chair 10 essentially comprises a lawn or garden-type outdoor chair having an articulated foldable frame, indicated generally by the reference numeral 12, and flexible seat and back material mounted on the frame and defining a chair seat 14 and a chair back 16, respectively. In FIGS. 1 through 4, the chair 10 is shown in set-up condition wherein it is adapted to rest on a generally horizontally oriented supporting surface for accommodating a seated or reclined chair occupant (not shown). In accordance with the present invention, when the chair 10 is not in use it may be moved into a selected one of two folded positions for transportation and/or storage, as will be hereinafter further discussed.

Figure 5:
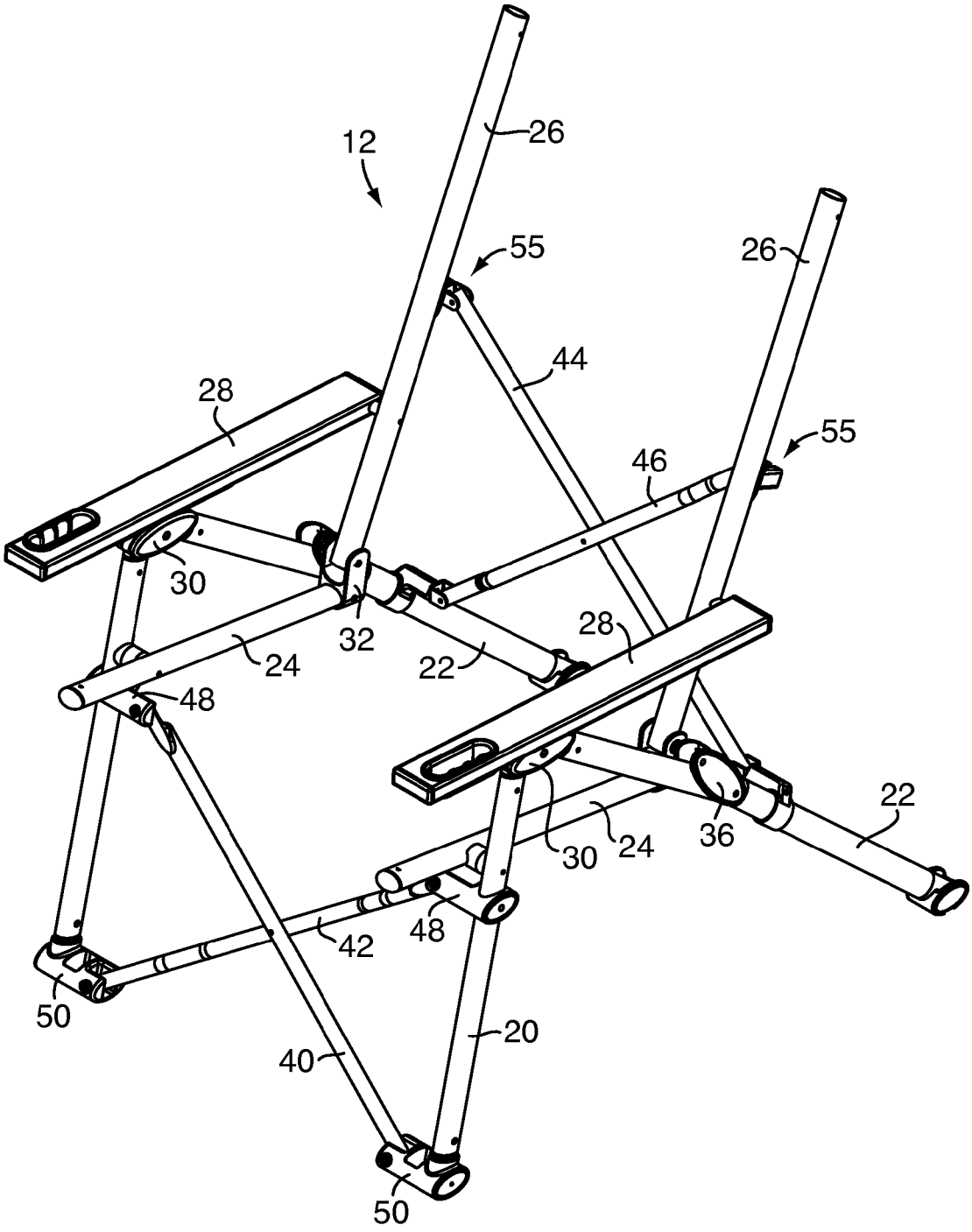
FIG. 5 is a perspective view of the chair frame shown in set-up position and with the flexible seat and back material removed therefrom to reveal the entire frame structure.

Considering now the chair frame 12 in further detail, as shown in FIG. 5 in set-up condition, the frame generally comprises a plurality of axial elongated structural members preferably fabricated from durable light weight tubular metal. The members can be aluminum tubing of circular or non-circular cross-section, such as extruded oval or elliptical tubing.

The frame 12 has a pair of side assemblies of substantially identical construction, essentially mirroring one another, indicated generally at 18L and 18R, and disposed in transversely spaced apart and generally parallel relation to each other when the chair 10 is in the set-up condition. Referring to a typical side assembly of the chair frame 12, such as the side assembly 18R, for example, best shown in FIG. 4, each side assembly has a plurality of rigid generally rectilinear axially elongated side members which include a front leg member 20, a rear leg member 22, a seat support member 24, a back support member 26, and an arm rest 28.

Figure 6:
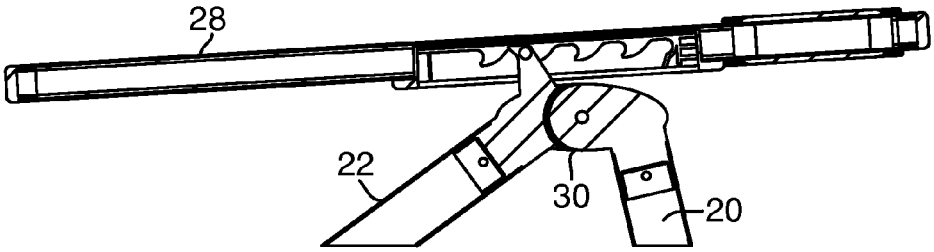
FIG. 6 is a fragmentary sectional view taken along the line 6-6 of FIG. 3.

The aforesaid side members are disposed within longitudinally extending generally parallel vertical planes and connected each to another for pivotal movement relative to each other about transversely extending parallel pivotal axes normal to the longitudinal axes of the members. More specifically, the front leg member 20 has a slight upward and rearward incline to the vertical when the chair 10 is in the set-up condition. As shown more particularly in FIG. 6, the front leg member 20 is pivotally connected at its upper end to the upper end of the rear leg member 22 by a hinge fitting 30, which maintains the front and rear leg members within a common horizontally extending vertically disposed axial plane for pivotal movement relative to each other.

Figure 2:
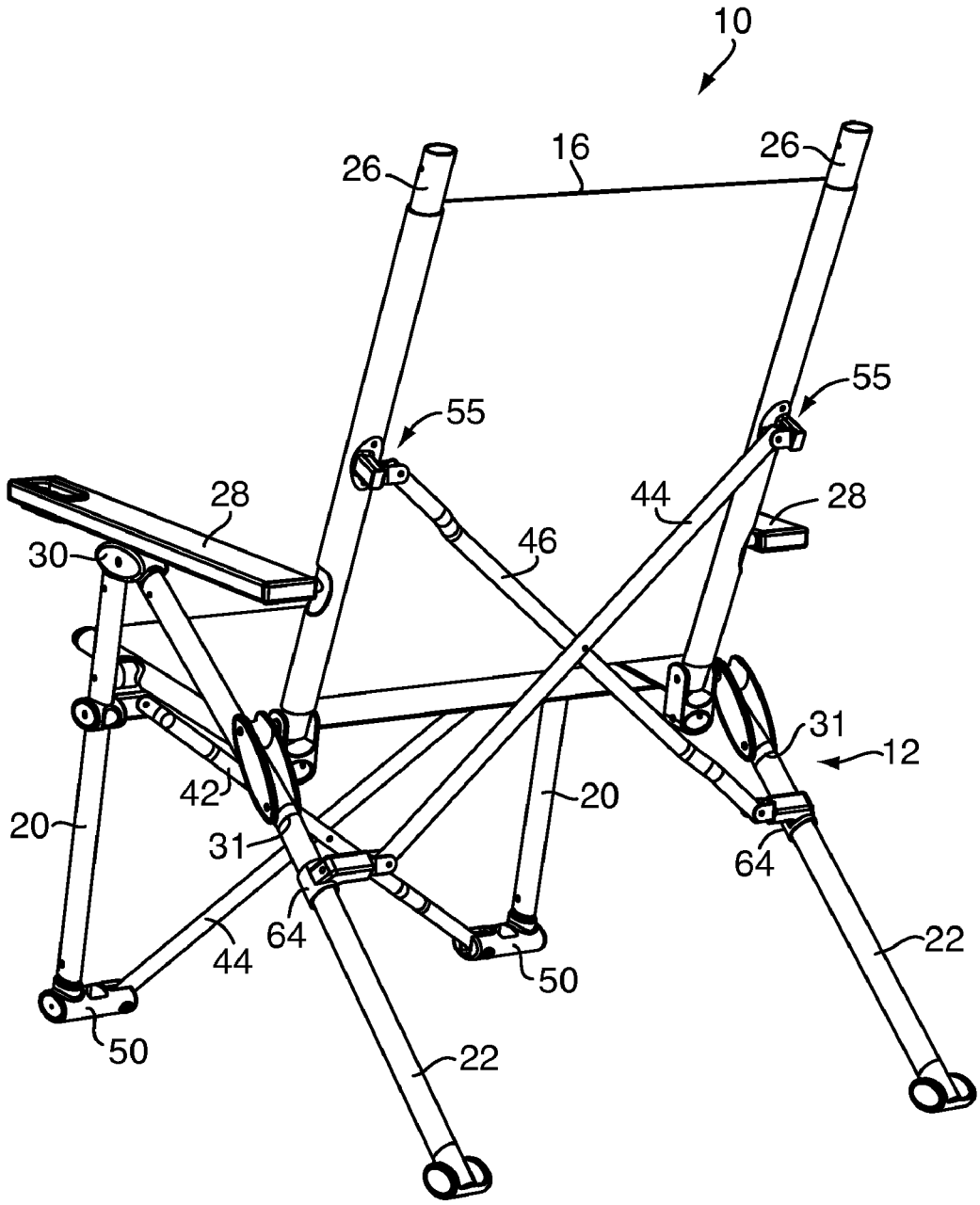
FIG. 2 is a rear perspective view of the chair of FIG. 1.

Referring to FIG. 2, the front portion of the rear leg member 22 has a slight downward and rearward incline to the horizontal and forms a junction 31 with the rear portion of the rear leg member 22 which has a somewhat greater downward and rearward incline than the front portion of the rear leg member 22.

Figure 3:
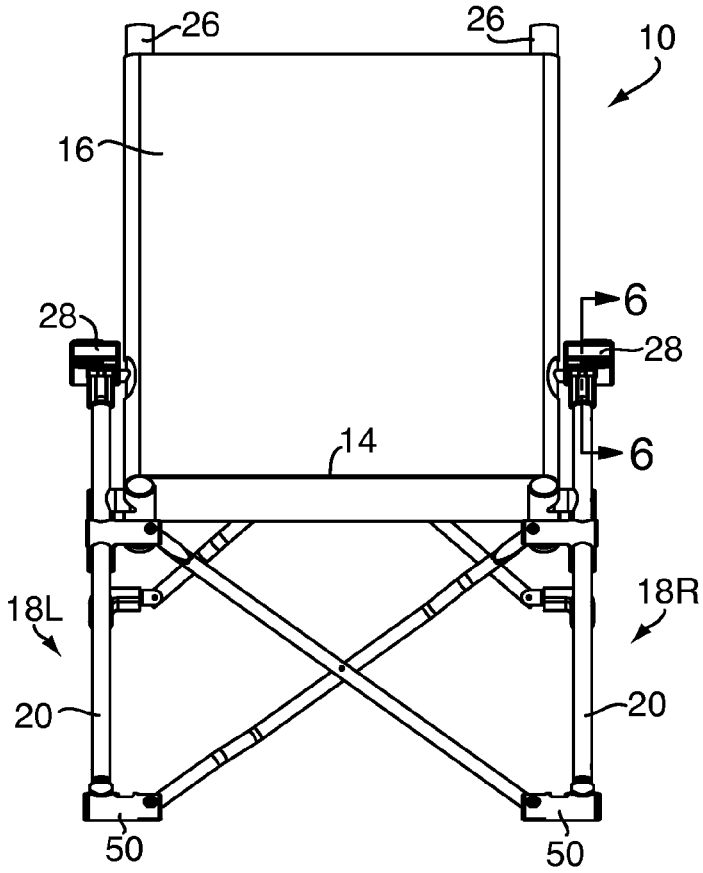
FIG. 3 is a front elevational view of the chair.
Figure 4:
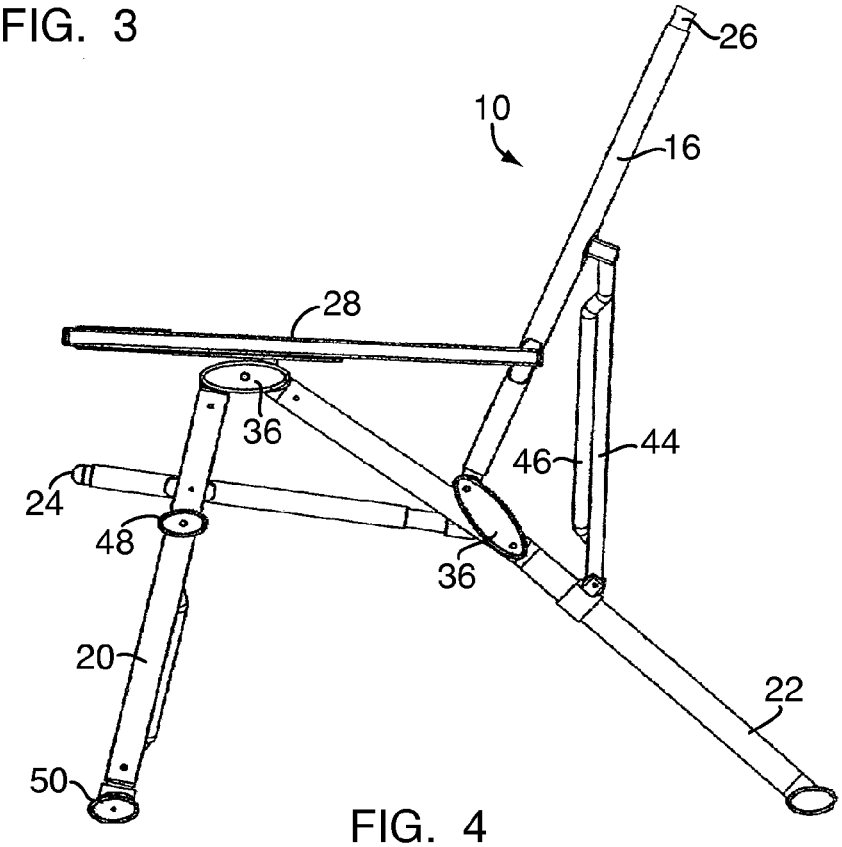
FIG. 4 is a side elevational view of the chair.
Figure 7:
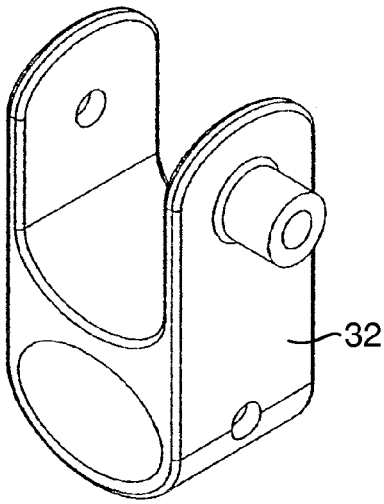
FIG. 7 is a somewhat enlarged perspective view of a seat support link.
Figure 8:
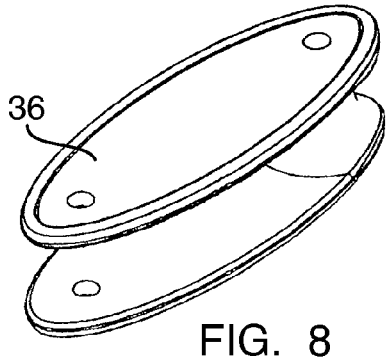
FIG. 8 is a somewhat enlarged perspective view of an over-the-center seat support link.
Figure 9:
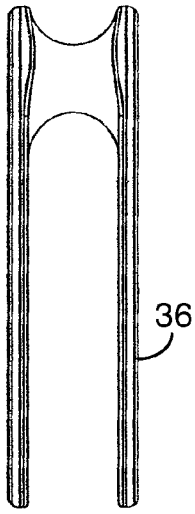
FIGS. 9 and 10 are somewhat further enlarged views of the right support link assembly as it appears in FIG. 5.
Figure 10:
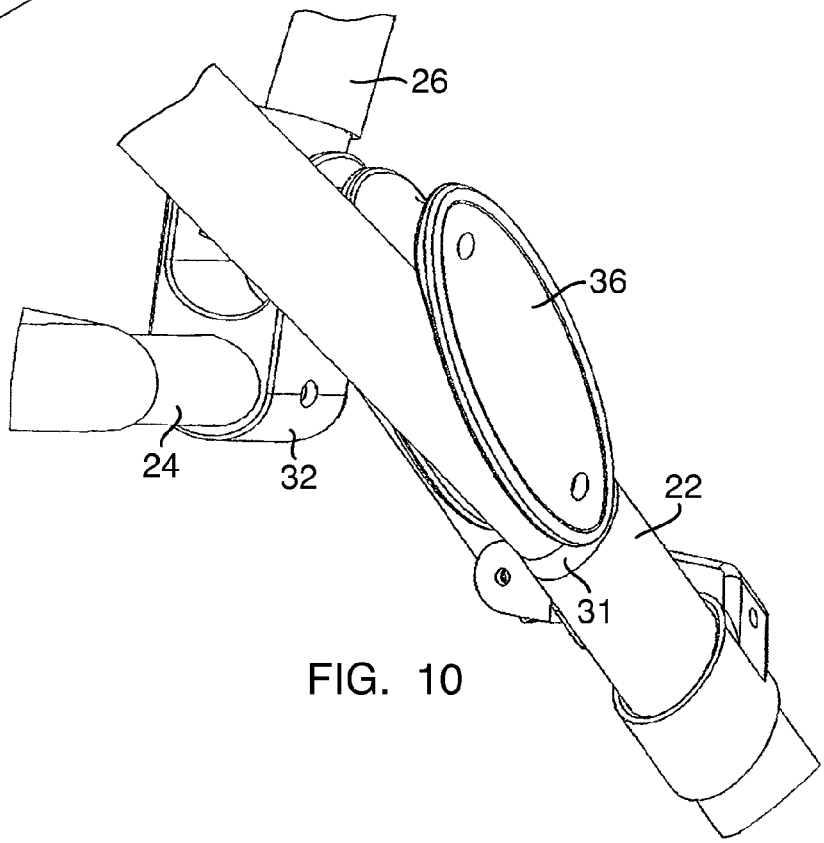
Figure 11:
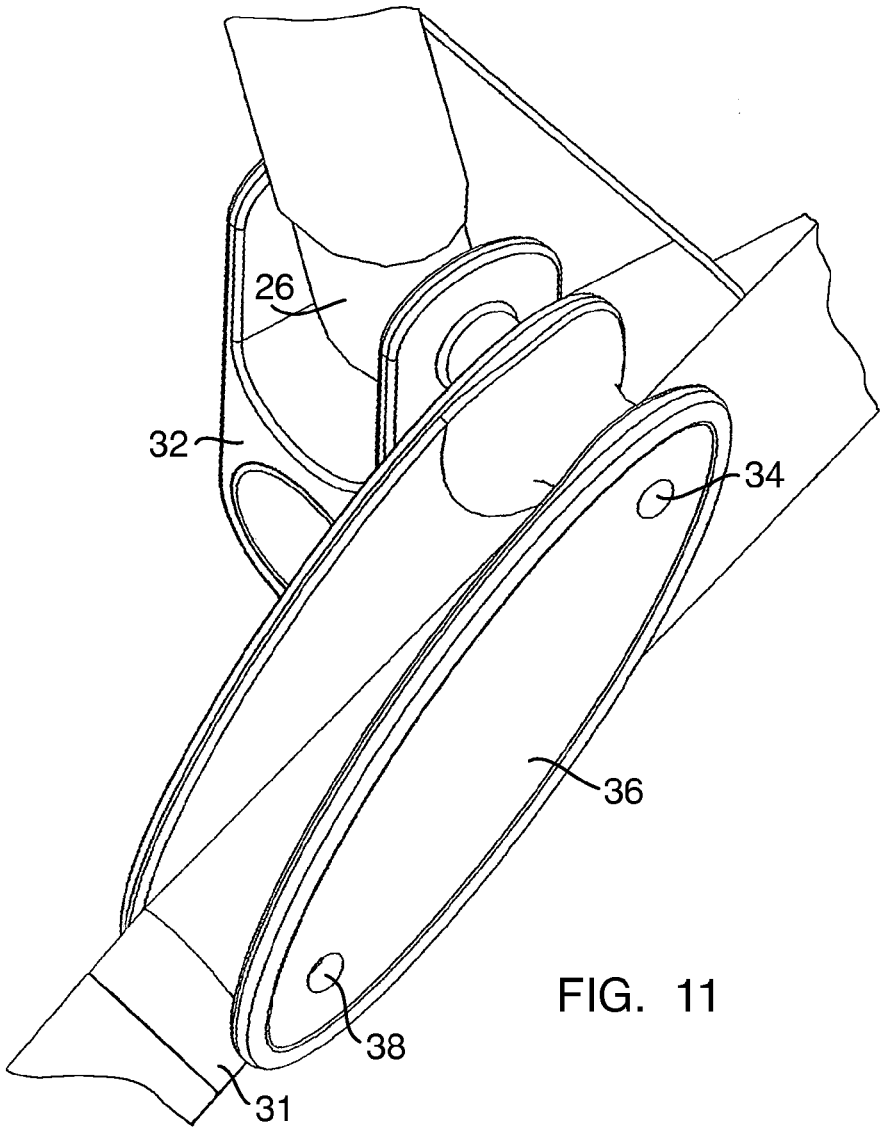
FIG. 11 is another perspective view of the link assembly of FIG. 10 shown a partially folded position of the chair.

The lower end of the back support member 26 is pivotally connected in upwardly offset relation to the rear end portion of the seat support member 24 by a U-shaped upwardly open offset pivot fitting 32 (FIG. 7) mounted in fixed position on and at the rear end of the seat support member 24 and a pivot pin 34 carried by the pivot fitting 32. The pivot pin 34 also pivotally connects the seat support member 24 and the back support member 26 to an upper end of an over-the-center link 36 (FIGS. 8-9) mounted in side-by-side relation to the pivot fitting 32, as shown in FIGS. 10-11. The lower end of the link 36 straddles the rear portion of the rear leg member 22 near the junction 31 and is pivotally connected to the rear leg member 22 by another axially transverse pivot pin 38, as shown in FIG. 11. Thus, the pivotally connected seat support and back support members 24 and 26 are connected together and supported as an assembled unit on the rear leg member 22 to pivot as a unit on and relative to that leg member. It should also be noted that the seat support and back support members 24 and 26 are supported to pivot relative to each other within a common plane parallel to and inward of the plane of the front and rear leg members (FIG. 3).

Further considering the frame 12, the side assemblies 18L and 18R are transversely connected to each other for simultaneous articulated movement that enable relatively easy and rapid movement of the chair 10 between set-up and folded conditions, as hereinafter further discussed.

Connection between the two side assemblies is provided by a plurality of axially elongated tubular connecting elements, which include a pair of front connecting elements 40 and 42 and a pair of rear connecting elements 44 and 46. The connecting elements are centrally pivotally connected to each other for pivotal movement relative to each other and attached to each one of the side assemblies by pivot and slide connections as hereinafter further described.

Figure 12:
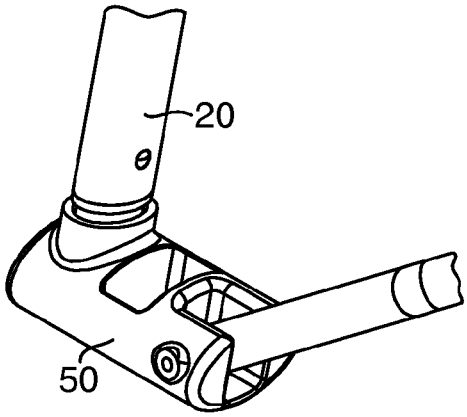
FIG. 12 is a somewhat enlarged fragmentary perspective view of the left hand front foot assembly as it appears in FIG. 5.
Figure 13:
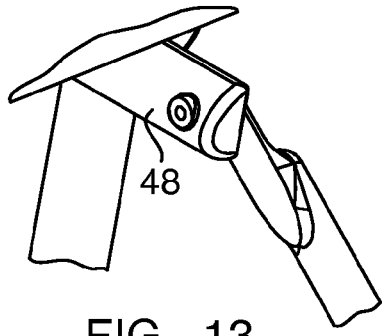
FIG. 13 is a somewhat enlarged fragmentary perspective view of the left hand front leg pivot assembly as it appears in FIG. 5.
Figure 24:
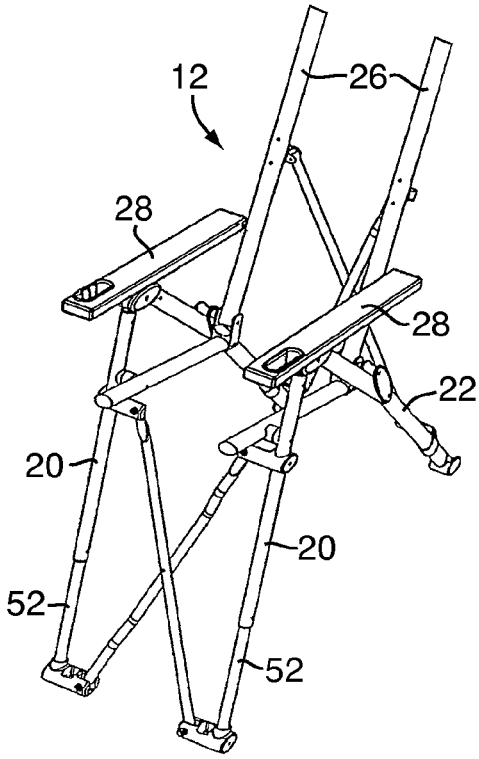
FIG. 24 is a front perspective view of the chair frame shown partially folded from its set-up condition shown in FIG. 4 to a generally transversely compressed condition.
Figure 25:
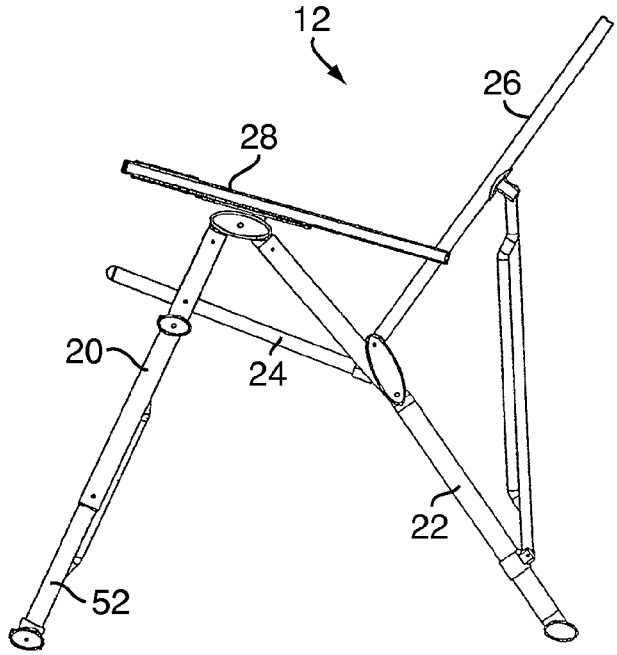
FIG. 25 is a side elevational view of the chair as shown in FIG. 24.
Figure 26:
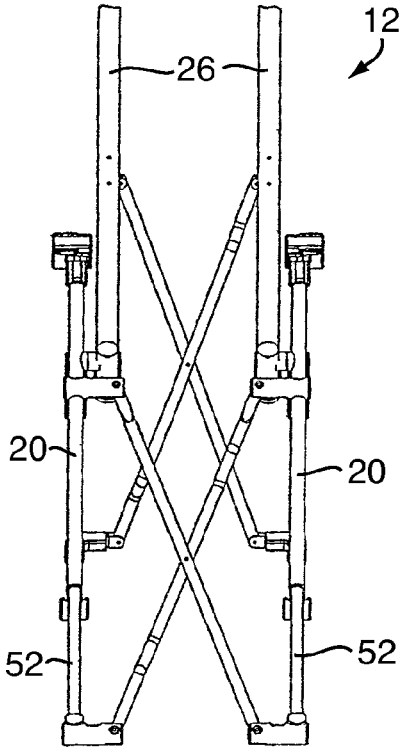
FIG. 26 is a front elevational view of the chair of FIG. 24.
Figure 27:
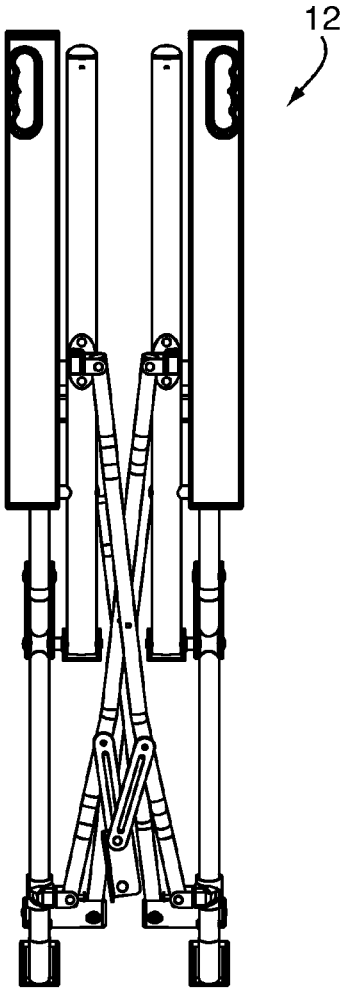
FIG. 27 is a front elevational view of the chair in its fully folded second position.
Figure 28:
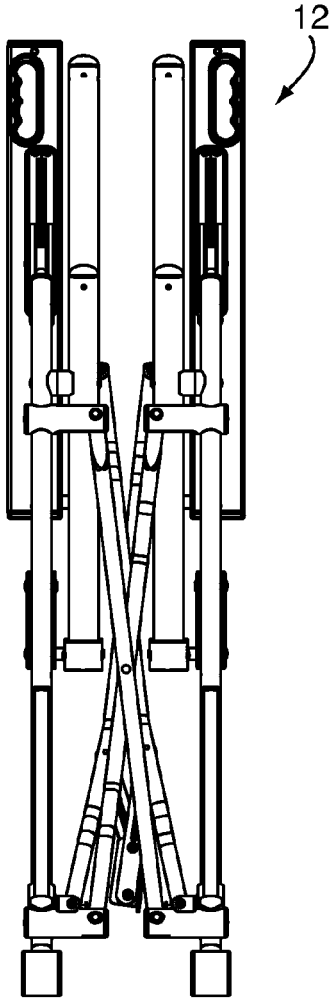
FIG. 28 is a rear elevational view of the fully folded chair of FIG. 27.
Figure 29:
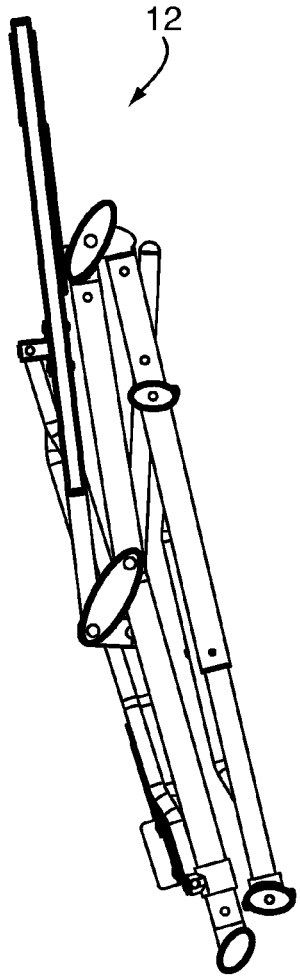
FIG. 29 is a right side elevational view of the fully folded chair.
Figure 30:
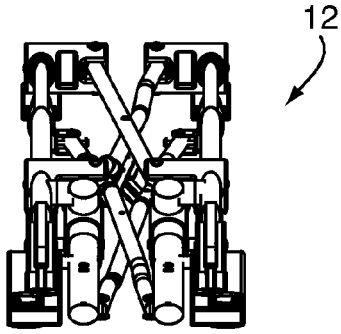
FIG. 30 is a top plan view of the fully folded chair in its second position.

Referring further to FIG. 5, the axially elongated front connecting elements 40 and 42 are each attached to both the right and left front legs 20, 20, which comprise part of the side assemblies 18L and 18R. The upper end of each of the connecting elements 40 and 42 is pivotally connected to an associated front leg member 20 by a pivot fitting 48 mounted in fixed position on the front leg member, as shown more particularly in FIG. 13. Each fitting 48 extends inwardly immediately below the front end portion of an associated seat support member 26. The upper terminal end is secured by an associated pivot pin to pivot on an associated fitting 48. The lower terminal end of each of the front connecting elements 40 and 42 is secured in a slot defined by front foot 50, as shown in FIG. 12 mounted in a fixed position on the lower end of an axially elongated slide connecting member 52. Each slide connecting member 52 is telescopically coaxially received in the lower end of an associated tubular front leg member 20 to slide within and relative to that leg member, as best shown in FIGS. 24-26 and for a purpose to be hereinafter evident. It should be noted that the connecting element 40 is located in front of the connecting element 42 and for this reason the terminal end portions of the connecting element 42 are forwardly offset so that the axes of all of the terminal ends and the axes of the front leg members 20, 20 lie within a common plane. The pivotal axes of all of the terminal ends are normal to the latter common plane and parallel to each other.

Figure 14:
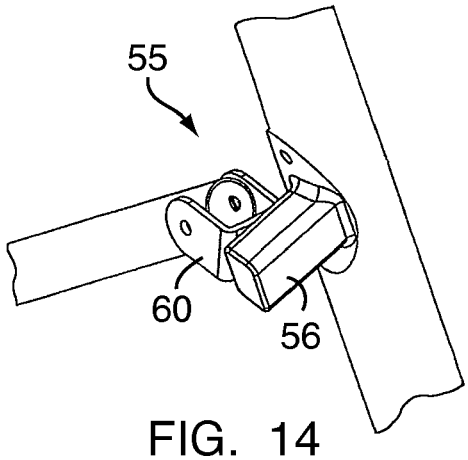
FIG. 14 is a somewhat enlarged fragmentary perspective view of the left hand back support coupling assembly.
Figure 16:
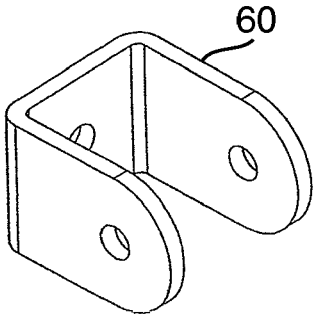
FIG. 16 is a somewhat enlarged perspective view of a clevis which forms a part of each rear universal pivotal coupling assembly.

The construction and arrangement of the rear connecting elements 44 and 46 and the manner in which these rear elements are connected to the side assemblies 18L and 18R will now be considered. Referring now particularly to FIG. 2, the rearmost connecting element 44 is substantially rectilinear, whereas the element 46 mounted forward of it has rearward offset terminal ends so that the terminal ends of both elements 44 and 46 lie within a common plane. Like the front connecting elements 40 and 42, the two rear connecting elements 44 and 46 are centrally connected for limited pivotal movement relative to each other and present an X-shaped configuration when the chair 10 is in the set-up condition and are disposed in side-by-side and near parallel relation to each other when the chair is folded to a fully bundled condition or a generally transversely compressed condition. The upper terminal ends of the connecting elements 44 and 46 are respectively connected to the left-hand and right-hand back support members 26, 26 for universal pivotal movement relative to those members. The aforesaid connections are provided by universal pivotal couplings indicated generally at 55, 55 and secured in fixed position on the rear surfaces of the back support members 26, 26, as shown more particularly in FIG. 14. Each coupling 55 has a boss 56 and includes an integral saddle which rests on the rear surface of an associated back support member 26 where it is secured in fixed position by fasteners or blind rivets. The saddle carries the rearward extending boss 56. A generally U-shaped transversely inwardly open clevis 60 is pivotally mounted on a generally transversely inwardly facing surface of the boss 56 by a first pivot pin to pivot about a transverse first axis. The upper terminal end of the rear connecting element 44 or 46 is received in the U-shaped clevis 60 (FIG. 16) and secured therein by a second pivot pin having a second axis normal to the transverse first axis of the first pivot pin. Thus, the two axes of the coupling 55 provide "universal" pivotal support for the upper terminal end of the rear connecting element 44 or 46. Thus, each universal coupling enables one part that is being moved to transmit motion to another part connected to it, even though the two parts may not be in alignment with each other.

Figure 15:
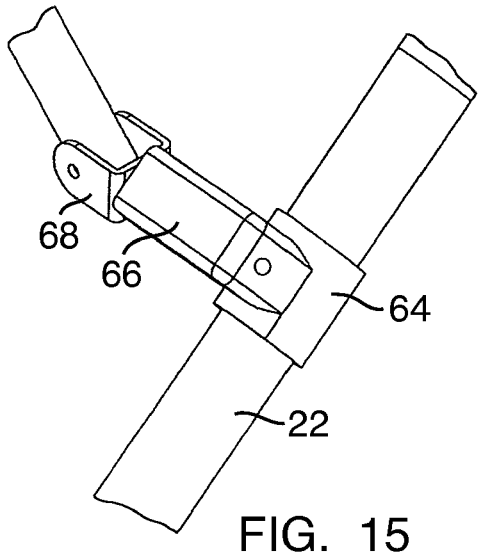
FIG. 15 is a somewhat enlarged fragmentary perspective view of the left hand universal pivot and rear leg slide assembly.

The lower terminal end of each of the rear connecting elements 44 and 46 is constructed and arranged to both pivot relative to and slide along a respectively associated rear leg member 22. Each rear leg member 22 has an associated slide fitting 62 mounted thereon and which includes a slide collar 64 received on the leg rearward of the rear leg member junction 31, as shown more particularly in FIG. 15. The collar 64 coaxially surrounds and generally complements the non-circular or oval cross sectional configuration of the associate rear leg member 22 and carries an integral transversely inwardly extending boss 66. For example, in FIG. 2, the collar 64 complements the non-circular shape or generally oval cross-sectional configuration of the rear leg member 22. A generally U-shaped inwardly open clevis 68 (similar to the clevis 60 shown in FIG. 16) is supported on the inner end of the boss 66 for pivotal movement about an axially transverse pivot pin mounted in fixed position on the boss 66. Thus, the lower terminal end of each of the rear connecting elements 44 and 46 is connected to a slide fitting 62 on the rear end portion of an associated rear leg member 22 for sliding movement in one and an opposite direction on and along that rear leg member 22 and for substantially universal pivotal movement relative to that rear leg member 22. Though illustrated herein with the sliding collar 64 on the rear leg member 22, the present invention can include connecting elements 44 and 46 where the upper part of the connecting elements are adapted to slide on or relative to the back rest support members 26.

It should be noted that the over-the-center linkage concept employed to support the chair back is well known in the folding chair art and has been utilized for many years in folding chairs to allow folding of a chair back into overlying relation to a chair seat while providing reliable support and stability to a back rest when a chair is in a set-up and usable condition. The present chair uses a modified form of this well known concept to provide a chair with a reclining back support 16 that can be easily collapsed to a flatly folded position, a generally transversely compressed position and a fully folded position.

The flatly folded position, hereinafter further discussed, refers to the conventional position well known in the art wherein a foldable chair is substantially vertically compressed from its normal set-up condition to a flattened condition wherein the chair legs are located immediately below and in generally parallel relation to the chair seat while the back rest overlies the upper surface of the seat. This flatly folded position, as generally illustrated in FIGS. 20-23 is hereinafter referred to as the first folded position.

The foldable chair of the present invention is also foldable from its normal set-up condition to a generally transversely compressed position, as generally illustrated in FIGS. 24-26, where the side assemblies are laterally and transversely moved towards each other while maintaining the generally parallel relation of the respective side assemblies. After being folded to this generally transversely compressed position, the chair 10 may be thereafter moved to a fully bundled condition whereby the seat and back support of the chair 10 are moved towards one another to a generally vertically compressed condition, such that all of the side members and all of the connecting members have generally parallel directions of extent.

The present chair is also adapted for movement from its set-up condition to and from a second folded position wherein the chair frame forms a bundle with all of the elongated side members and all of the elongated connecting elements which comprise the frame having generally common directions of extent and the seat material and back material forming part of the bundle and having a flaccid condition. This fully bundled condition, as generally illustrated in FIGS. 27-30, is hereinafter referred to as the second folded position.

When the chair 10 is not in use it may be prepared for storage by folding into one of its three folded positions. As previously noted, the first position is a conventional flatly folded position well known in the folding chair art, wherein the two side frame assemblies 18R and 18L are maintained in transversely spaced apart relation to each other by the front and rear X frames formed by the connecting elements, as shown in FIGS. 20-23. The terminal ends of the front connecting elements 40 and 42 are connected only to the front leg members 20, 20 therefore, the front connecting elements remain dormant during the flatly folding operation. However, the terminal ends of the rear connecting elements 44 and 46 are connected to side members that pivot relative to each other during the flat folding operation, therefore, universal pivotal couplings and slide connectors are provided to connect the rear connecting elements to the back support members 26 and the rear leg members 22. Accordingly, the chair 10 may be described as being vertically compressed from its set-up condition to its first or flatly folded position.

Figure 17:
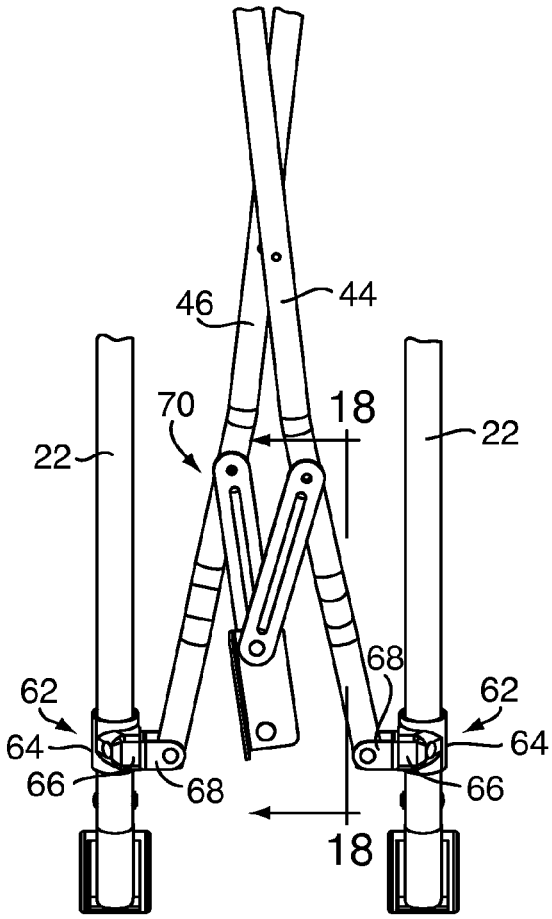
FIG. 17 is a somewhat enlarged fragmentary view of a rear latch bar assembly shown in closed position.
Figure 18:
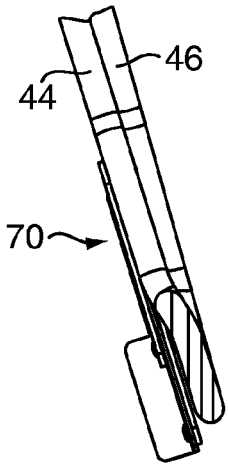
FIG. 18 is a somewhat further enlarged fragmentary sectional view taken along the line 18-18 of FIG. 17.
Figure 19:
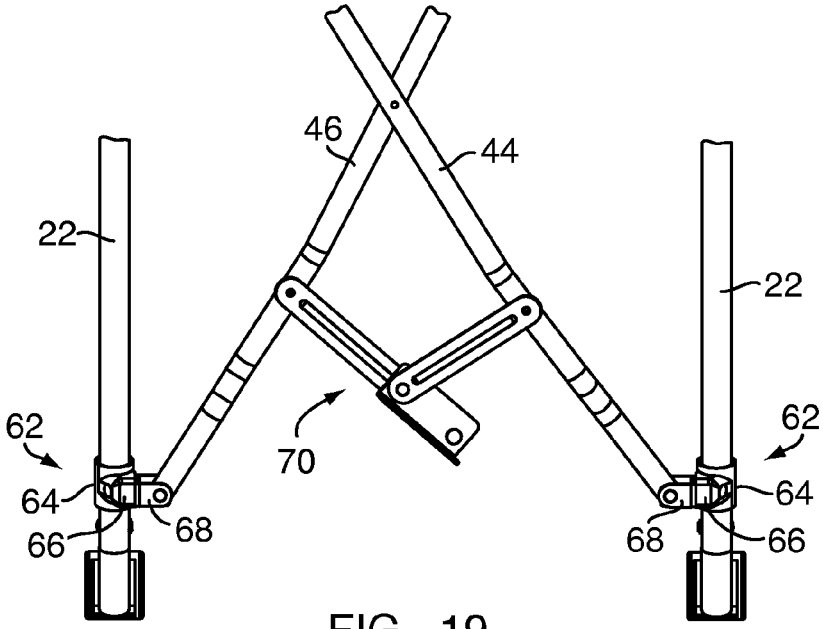
FIG. 19 is a fragmentary view of a rear latch bar assembly shown in partially open position.
Figure 20:
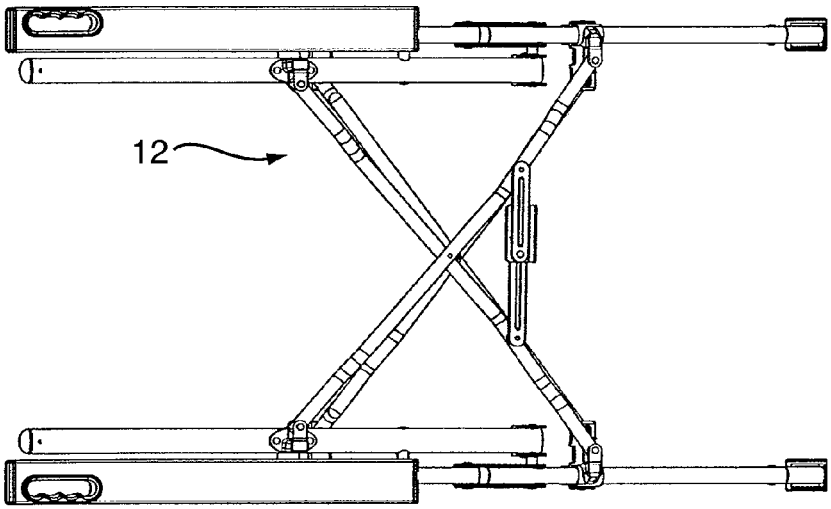
FIG. 20 is a top plan view of the chair frame and showing the frame vertically compressed from its set-up condition shown in FIG. 4 and with the back support members generally overlying the seat support members.
Figure 21:
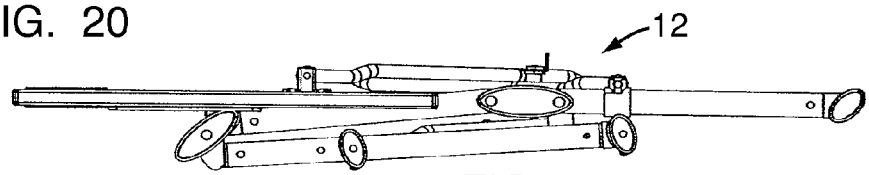
FIG. 21 is a right side elevational view of the vertically compressed chair frame as it appears in FIG. 20.
Figure 22:
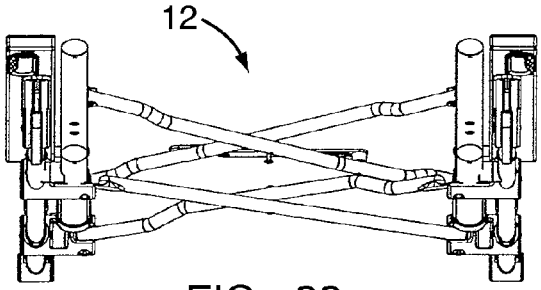
FIG. 22 is a front elevational view of the flatly folded chair frame of FIG. 20.
Figure 23:
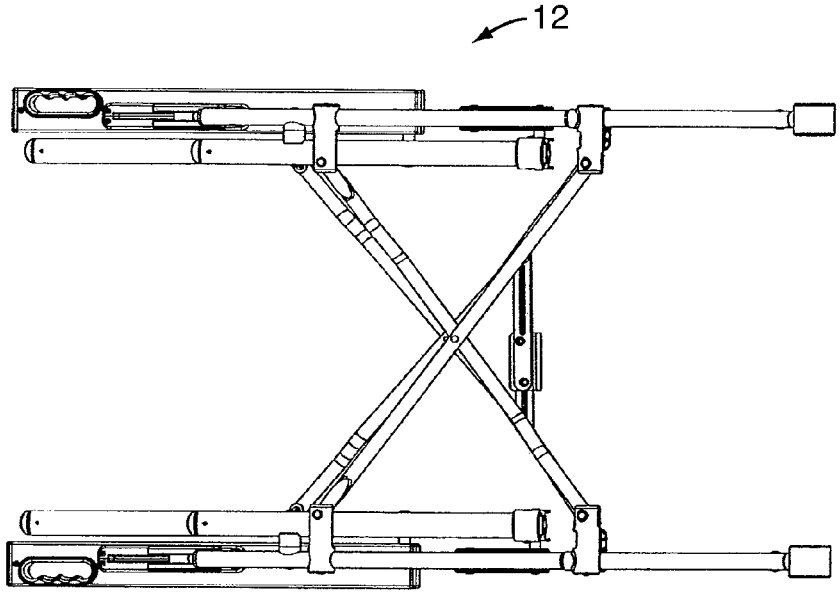
FIG. 23 is a bottom plan view of the flatly folded chair frame of FIG. 20.

A latching device indicated generally at 70 and shown in FIGS. 17-19 is connected between the rear connecting elements 44 and 46 and serves to maintain the connecting elements in an open position. This latching device also serves as a means for preventing movement of the chair to its second folded position, or an intermediate generally transversely compressed position. It should be noted that at all times the chair may be folded and unfolded between its set-up condition and its first or flatly folded position. Since the chair 10 is folded from its set-up condition, it is convenient to describe the further folding operation as a transverse or lateral compression of the frame. Before performing this operation, the latching device 70, which may be provided to maintain the frame in its laterally open and transversely spaced apart condition, must be placed in a released position (as shown in FIG. 19). Thereafter, the side frame assemblies are moved laterally and in a horizontal direction toward each other. At this point the various connecting elements move from their respective X-shaped open configuration to a position of near parallel relation to each other, which results in extension of the front slide connections 52, 52 that are telescopically received within the front legs 20, 20. As the front connecting elements move toward a closed position, the front slide connectors move from a retracted position within the front legs to an extended position wherein these slide connections 52 extend for some distance from the front legs 20, 20, as shown in FIGS. 24-26.

It should now be apparent that folding the chair to its second folded position entails two separate and distinct folding operations, which may be performed in any order. Thus, the chair 10 may be folded from its set-up condition to its flatly folded first folded position (FIGS. 20-23) and thereafter be laterally and transversely compressed to its second folded position—i.e., fully bundled condition—(FIGS. 27-30) or, if desired, the frame may be first laterally and transversely compressed from its set-up condition to its generally transversely compressed condition, as illustrated in FIGS. 24-26 and thereafter vertically compressed to a flat and fully bundled condition (FIGS. 27-30). In either instance, the end result will be the same—namely a compact bundle wherein the various axially elongated structural members and connecting elements will be disposed in relatively closely spaced apart side-by-side relation to each other and have a common general direction of axial extent.

When the chair is in its set-up condition, the flexible seat and back material will be generally taut and flatly disposed on the frame. However, when the chair is folded to its second folded position, the seat and back material will be in a flaccid condition and form a part of the bundle.

Figure 31:
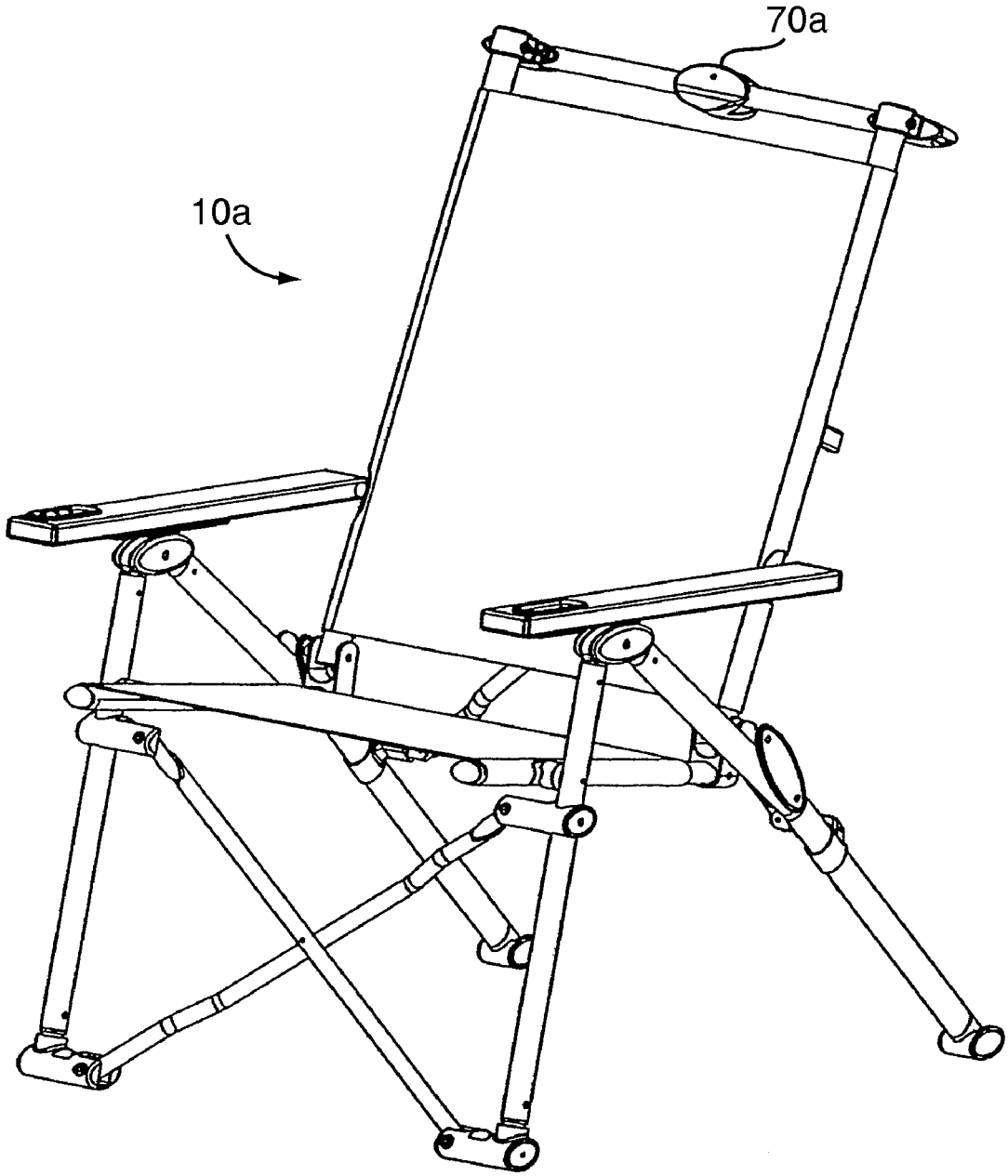
FIG. 31 is a front perspective view of another two-way foldable chair embodying the present invention and shown in set-up condition ready for use.

Referring now to FIG. 31, another foldable chair design embodying the present invention is indicated generally at 10*a*. The chair 10*a* includes an alternative design for a latching device 70*a* which operates in the manner described above for preventing lateral or transverse movement of the side assemblies of chair 10*a*. The latching device 70*a* also serves to maintain the connecting elements in their open position. As shown in FIG. 31, the latching device 70*a* is positioned at the top of the chair's back support. As shown, the latching device 70*a* is in its locked condition such that the chair 10*a* can only be folded from its set-up condition (shown) to a first flatly folded position. In order to fold the chair 10*a* to its second, fully bundled condition or an intermediate generally transversely compressed condition, the latching device 70*a* must first be unlocked—e.g., by releasing the linkage so that the device collapses at the center thereof.

I claim:

1. A two-way foldable chair comprising:

an articulated foldable frame;

a flexible seat material mounted on said frame; and a flexible back material mounted on said frame;

said frame being adapted to rest on a generally horizontally oriented supporting surface in a set-up position with said flexible seat material defining a chair seat and said flexible back material defining a chair back for collectively accommodating a seated chair occupant;

said frame having a pair of side assemblies disposed in generally parallel longitudinally extending and transversely spaced apart relation to each other in said set-up position, each of said side assemblies having a plurality of generally axially elongated side members, said side members of each of said assemblies being disposed within generally parallel longitudinally extending vertical planes and each member being connected with at least one other member for pivotal movement relative to each other about generally transversely extending pivotal axes;

said frame further having a plurality of generally axially elongated connecting elements extending between and connected to said side assemblies by at least one of a pivot connection and a slide connection and supporting said side assemblies for transverse movement toward each other and into a generally transversely compressed condition and away from each other and to said generally transversely spaced apart condition;

said chair being movable from said set-up position to a first folded position wherein said chair back generally overlies said chair seat and said side assemblies remain in said generally transversely spaced apart condition so that said frame has a generally flat configuration;

said chair also being adapted for movement to and from said set-up position to and from a second folded position wherein said chair forms a bundle with all of said side members and all of said connecting elements having generally common directions of extent and said seat material and said back material forming part of said bundle, each having a flaccid condition.

2. The two-way foldable chair as set forth in claim 1, wherein said chair moves from said set-up position to said first folded position in response to forward and downward pivotal movement of said chair back into generally overlaying relation to said chair seat.

3. The two-way foldable chair as set forth in claim 2, wherein said chair moves from said first folded position to said second folded position in response to movement of said side assemblies to said generally transversely compressed condition.

4. The two-way foldable chair as set forth in claim 1, wherein said chair may be moved directly from said set-up position to said second folded position by moving said side assemblies to said generally transversely compressed condition and thereafter moving said side assemblies to a generally vertically compressed condition with all of said side members and all of said connecting elements having generally parallel directions of extent.

5. The two-way foldable chair as set forth in claim 1, wherein said chair includes means for preventing said chair from being moved to said second folded position.

6. The two-way foldable chair as set forth in claim 5, wherein said chair is at all times movable between said set-up position and said first folded position.

7. The two-way foldable chair as set forth in claim 5, wherein said means for preventing comprises means for releasably retaining said side assemblies in said generally transversely spaced apart condition.

8. The two-way foldable chair as set forth in claim 7, wherein said means for releasably retaining comprises a manually operable latching device mounted on said chair frame.

9. The two-way foldable chair as set forth in claim 8, wherein said latching device comprises a latch bar having a plurality of pivotally connected parts and an operating handle.

10. The two-way foldable chair as set forth in claim 1, wherein each of said side assemblies includes a front leg member, a rear leg member, a seat material support member, a back material support member, and an arm rest member.

11. The two-way foldable chair as set forth in claim 10, wherein each of said side assemblies includes a connecting link pivotally connected to and extending between at least two of said front leg member, said rear leg member, said seat support member, said back material support member, and said arm rest member.

12. The two-way foldable chair as set forth in claim 11, wherein said connecting link comprises an over-the-center link.

13. The two-way foldable chair as set forth in claim 12, wherein two of said members are supported to pivot relative to a third one of said members.

14. The two-way foldable chair as set forth in claim 11, wherein said connecting link is pivotally connected to and extends between three of said front leg member, said rear leg member, said seat support member, said back material support member, and said arm rest member.

15. The two-way foldable chair as set forth in claim 11, wherein said connecting link is pivotally connected to and extends between the seat support member, the back support member, and the rear leg member.

16. The two-way foldable chair as set forth in claim 10, comprising a pair of pivotally connected rear connecting elements that extend between and are connected at terminal ends thereof to the rear leg member and the back material support member of each side assembly; and further comprising a latching device extending between said rear connecting elements.

17. The two-way foldable chair as set forth in claim 16, wherein said latching device comprises a latch bar having a plurality of pivotally connected parts and an operating handle for moving said pivotally connected parts between a locked condition and an unlocked condition.

18. A two-way foldable chair comprising:

an articulated foldable frame;

a flexible chair seat material mounted on said frame; and a flexible chair back material mounted on said frame;

said frame being adapted for resting on a generally horizontally oriented surface in a set-up position with said flexible chair seat material defining a generally horizontally disposed chair seat and said flexible chair back material defining a generally upwardly extending chair back for accommodating a seated chair occupant;

said frame having a pair of side assemblies disposed in generally parallel and transversely spaced apart relation to each other in said set-up position, each of said side assemblies having a plurality of generally axially elongated side members, said side members of each of said side assemblies being disposed within longitudinally extending generally parallel vertical planes and each member being connected with at least one other member for pivotal movement relative to each other about generally transversely extending pivotal axes;

said frame having a plurality of generally axially elongated connecting elements extending between and connected to said side assemblies by at least one of a pivot connection and a slide connection and supporting said side assemblies for transverse movement toward each other and into a generally transversely compressed condition and away from each other and to said generally transversely spaced apart condition;

said chair being movable from said set-up position to a first folded position wherein said chair back generally overlies said chair seat and said side assemblies remain in said generally transversely spaced apart condition so that said frame has a generally flat configuration;

said chair also being movable from said set-up position to and from a second folded position wherein said chair forms a bundle with all of said side members and all of said connecting elements having generally common directions of extent and said seat material and said back material forming a part of said bundle, each having a flaccid condition;

said chair further being directly movable from said set-up position to said second folded position by moving said side assemblies to said generally transversely compressed condition and thereafter moving said side assemblies to a generally vertically compressed condition with all of said side members and all of said connecting elements having generally parallel directions of extent;

said chair also having a latching device mounted on said frame for releasably retaining said side assemblies in said transversally spaced apart condition and thereby preventing said chair from being moved to said second folded position, wherein said latching device includes an operating handle; and said chair at all times being movable between said set-up position and said first foldable position.

19. The two-way foldable chair as set forth in claim 18, wherein said chair moves from said set-up position to said first folded position in response to forward and downward pivotal movement of said chair back into generally overlaying relation to said chair seat.

20. The two-way foldable chair as set forth in claim 19, wherein said chair moves from said first folded position to said second folded position in response to movement of said side assemblies to said generally transversely compressed condition.

21. The two-way foldable chair as set forth in claim 18, wherein each of said side assemblies includes a front leg member, a rear leg member, a seat material support member, a back material support member, and an arm rest member.

22. The two-way foldable chair as set forth in claim 21, wherein each of said side assemblies includes a connecting link pivotally connected to and extending between at least two of said front leg member, said rear leg member, said seat support member, said back material support member, and said arm rest member.

23. The two-way foldable chair as set forth in claim 21, comprising a pair of pivotally connected rear connecting elements that extend between and are connected at terminal ends thereof to the rear leg member and the back material support member of each side assembly;

wherein the latching device extends between said rear connecting elements.

24. The two-way foldable chair as set forth in claim 18, wherein the chair back is reclinably adjustable to a number of positions.

25. The two-way foldable chair as set forth in claim 1, wherein the chair back is reclinably adjustable to a number of positions.

* * * * *